US009586740B2

(12) United States Patent
James et al.

(10) Patent No.: US 9,586,740 B2
(45) Date of Patent: Mar. 7, 2017

(54) DISPENSING CONTAINER AND METHOD

(71) Applicant: Dow Global Technologies LLC, Midland, MI (US)

(72) Inventors: Timothy James, Brooklyn, NY (US); Haley A. Lowry, Houston, TX (US); Jill M. Martin, Brazoria, TX (US)

(73) Assignee: DOW GLOBAL TECHNOLOGIES LLC, Midland, MI (US)

( * ) Notice: Subject to any disclaimer, the term of this patent is extended or adjusted under 35 U.S.C. 154(b) by 284 days.

(21) Appl. No.: 13/971,227

(22) Filed: Aug. 20, 2013

(65) Prior Publication Data

US 2014/0231452 A1 Aug. 21, 2014

Related U.S. Application Data

(63) Continuation-in-part of application No. 29/446,111, filed on Feb. 20, 2013, now Pat. No. Des. 716,668.

(51) Int. Cl.

*B65D 35/56* (2006.01)
*B65D 75/00* (2006.01)
*B65D 75/58* (2006.01)

(52) U.S. Cl.

CPC ..... *B65D 75/008* (2013.01); *B65D 75/5883* (2013.01)

(58) Field of Classification Search

CPC .... B65D 35/44; B65D 47/247; B65D 75/008; B65D 75/5883
USPC ..... 222/207, 105, 212, 213, 215, 525, 107, 222/205
See application file for complete search history.

(56) References Cited

U.S. PATENT DOCUMENTS

| | | | | |
|---|---|---|---|---|
| 3,191,806 | A * | 6/1965 | Schultz et al. | 222/41 |
| D243,121 | S | 1/1977 | Ralston, Jr. et al. | |
| D304,546 | S | 11/1989 | Cattach | |
| 5,307,955 | A | 5/1994 | Viegas | |
| D360,824 | S | 8/1995 | Ossendryver | |
| 5,460,298 | A * | 10/1995 | DiBiase | B67D 3/0029 222/173 |
| D447,694 | S | 9/2001 | Leggett | |
| 7,066,360 | B2 | 6/2006 | Hearld et al. | |
| 7,261,221 | B2 | 8/2007 | Awbrey et al. | |
| D573,897 | S | 7/2008 | Berman | |
| D587,122 | S | 2/2009 | Herstol et al. | |
| D603,957 | S | 11/2009 | Sato et al. | |
| D609,101 | S | 2/2010 | Herstol et al. | |

(Continued)

FOREIGN PATENT DOCUMENTS

| | | | |
|---|---|---|---|
| JP | 2000309347 | A | 11/2000 |
| JP | 2007197044 | A | 8/2007 |

(Continued)

*Primary Examiner* — Kevin P Shaver
*Assistant Examiner* — Robert Nichols, II
(74) *Attorney, Agent, or Firm* — Husch Blackwell LLP

(57) ABSTRACT

The present disclosure provides a container for dispensing a liquid from the container. The container includes a flexible body having a closed top and an open bottom and a base attached to the open bottom of the body. The body and base define a chamber for holding a liquid. The base includes a floor and a peripheral rim extending below the floor. A nozzle extends from the floor. A closure slidingly engages with the nozzle. The closure includes a panel-cap having an aperture through which the liquid is dispensed.

15 Claims, 4 Drawing Sheets

(56) References Cited

U.S. PATENT DOCUMENTS

| | | | | |
|---|---|---|---|---|
| D626,857 | S | 11/2010 | Spanjaard | |
| D631,363 | S | 1/2011 | Herstol et al. | |
| 7,874,466 | B2 | 1/2011 | McConville et al. | |
| 8,087,547 | B1 * | 1/2012 | Lindsey | 222/184 |
| 8,662,360 | B2 | 3/2014 | Yuan | |
| 8,844,767 | B1 * | 9/2014 | Bates et al. | 222/107 |
| 2010/0021089 | A1 | 1/2010 | Arvizu | |
| 2012/0187157 | A1 | 7/2012 | Yuan | |

FOREIGN PATENT DOCUMENTS

| | | | |
|---|---|---|---|
| WO | 94/00363 | A1 | 1/1994 |
| WO | 99/08942 | A1 | 2/1999 |

* cited by examiner

DISPENSING CONTAINER AND METHOD

PRIORITY

This application claims priority to U.S. Design patent application Ser. No. 29/446,111 filed on 20 Feb. 2013, the entire content of which is incorporated by reference herein.

BACKGROUND

Liquid personal care products, such as shampoo and liquid body washes (i.e., shower gels), have historically been packaged in upright bottles having flip-top closures. More recently, liquid body washes are being contained in inverted bottles (i.e., "tottle packages"). A tottle package rests on its dispensing cap, thereby allowing gravity to pull the liquid composition towards the opening to facilitate easier dispensing when the package is opened for dispensing.

Conventional tottle packages with flip top closures (as well as packages with twist-up closures and screw-top closures) typically require the consumer to use two hands to open and close such closures. This is inconvenient, especially when the consumer product being dispensed is a liquid body wash or hair shampoo. When a consumer uses a liquid body wash, for example, she typically dispenses the body wash into her hand. The consumer cannot utilize her hand containing the product to close product package.

A need therefore exists for a liquid personal care product container that can be readily closed with one hand. A need further exists for a container that dispenses a liquid personal care product from the bottom of the container and can be closed with one hand.

SUMMARY

The present disclosure provides a container for dispensing a liquid and method. In an embodiment, a container is provided. The container includes a flexible body. The flexible body has a closed top and an open bottom. The body defines a chamber for holding a liquid. Attached to the open bottom of the body is a base. The base includes a floor and a peripheral rim extending below the floor. A nozzle extends from the floor. A closure slidingly engages with the nozzle. The closure includes a panel-cap having an aperture through which the liquid is dispensed.

The present disclosure provides a method. In an embodiment, a method for dispensing a liquid is provided and includes providing a container. The container includes (i) a flexible body having a closed top and an open bottom, the body defining a chamber for holding a liquid, (ii) a base attached to the open bottom of the body, the base comprising a floor and a peripheral rim extending below the floor, (iii) a nozzle extending from the floor, and (iv) a closure slidingly engaged with the nozzle, the closure comprising a panel-cap having an aperture through which the liquid is dispensed.

The method further includes placing a finger on a top surface of the panel-cap; pulling the panel-cap away from the body to open the aperture; and dispensing an amount of liquid from the container.

In an embodiment, the dispensing step includes squeezing the flexible body.

In an embodiment, the method includes placing the base on a support surface; and closing the closure. The weight of the container itself is sufficient to close the open closure, making the container a self-closing container.

DETAILED DESCRIPTION

Figure 1:
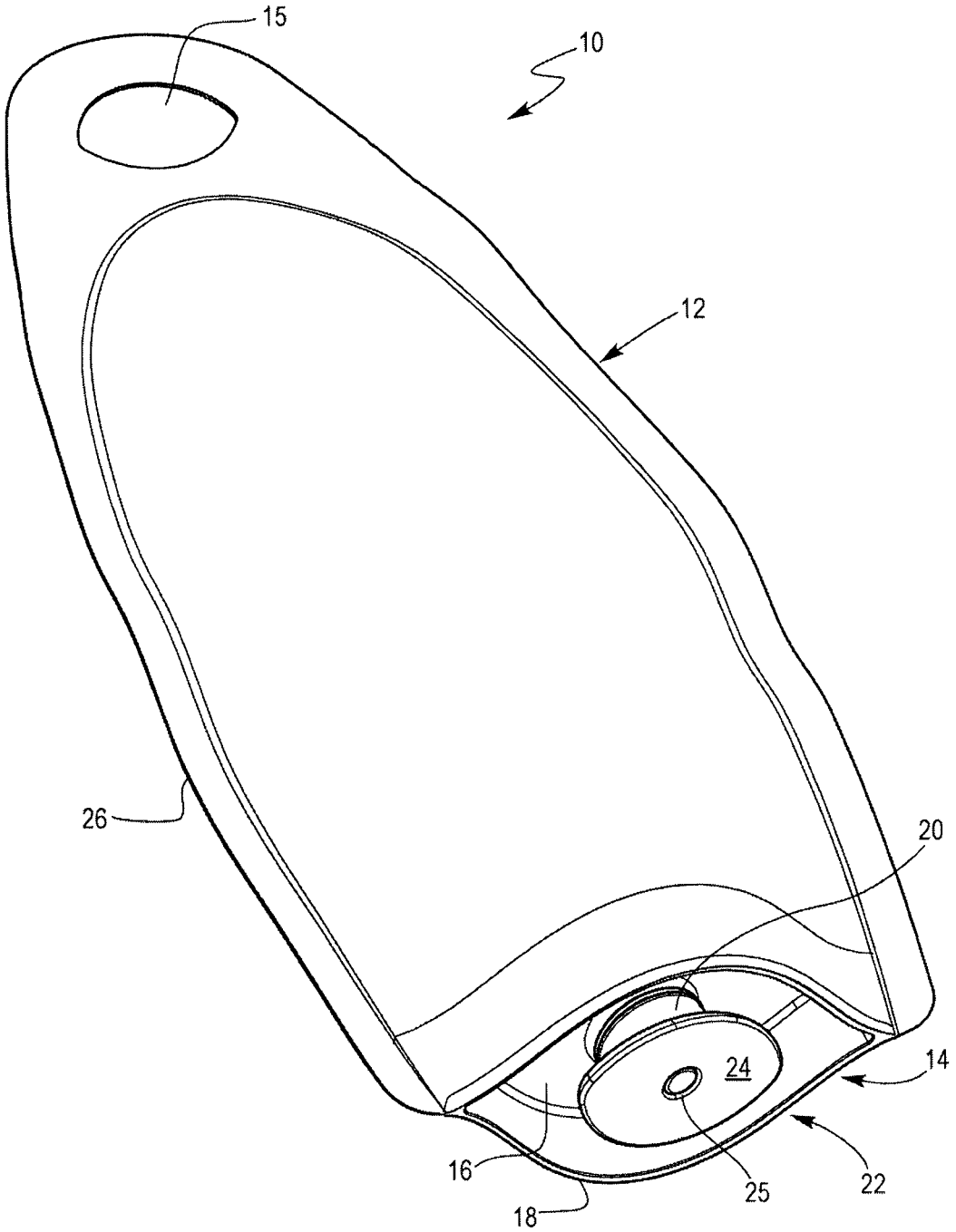
FIG. 1 is a bottom perspective view of a container in accordance with an embodiment of the present disclosure.

The present disclosure provides a container for dispensing a liquid. The container includes a flexible body having a closed top and an open bottom. The body defines a chamber for holding a liquid. The container also includes a base attached to the open bottom of the body. The base includes a floor and a peripheral rim extending below the floor. The container also includes a nozzle extending from the floor. The container further includes a closure. The closure is slidingly engaged with the nozzle. The closure includes a panel-cap having an aperture through which the liquid is dispensed. The container is a bottom-dispensing container, also known as an inverted dispensing container.

1. Body

The present container includes a flexible body having a closed top and an open bottom. The body is constructed from a flexible film of polymeric material. The flexible film may be a monolayer structure or a multilayer structure. The body is resilient, flexible and deformable. The body defines a chamber for holding a liquid. The body can be made from a single film (a film folded over upon itself and peripherally sealed) or two films peripherally sealed along a common peripheral edge. The flexible film is sealed around the periphery to form a chamber for holding a liquid. The peripheral seal for the body can be a heat seal, an ultrasonic seal, or a radio frequency (RF) seal.

Each of the front film and the rear film is resilient, flexible and deformable. Correspondingly, the body is resilient, flexible, and deformable. The body is flexible enough to deform, but also resilient enough to return to its original shape.

The flexible film is made from one or more polymeric materials. Nonlimiting examples of suitable polymeric materials include olefin-based polymer, propylene-based polymer (including plastomer and elastomer, random copolymer polypropylene, homopolymer polypropylene, and propylene impact copolymer) and ethylene-based polymer (including plastomer and elastomer, high density polyethylene ("HDPE"), low density polyethylene ("LDPE"), linear low density polyethylene ("LLDPE"), and medium density polyethylene ("MDPE")), olefin block copolymer, polyethylene terephthalate ("PET"), oriented polyethylene terephthalate ("OPET"), nylon, biaxially oriented polypropylene (BOPP), ethylene vinyl alcohol (EVOH), functionalized ethylene-based polymers such as ethylene-vinyl acetate ("EVA"), maleic anhydride-grafted polyethylene, and ethylene acrylate copolymers, fluorinated ethylene propylene, blends thereof, and multilayer combinations thereof.

The flexible film has a thickness from 25 microns, or 50 microns, or 75 microns to 100 microns, or 125 microns, or 150 microns, or 200 microns, or 220 microns.

In an embodiment, the body is made from two films, each film made from a flexible polymeric material. The composition of each film may be the same or different. In a further embodiment, the body is made from two films, the films being made of the same material.

In an embodiment, the flexible film is a multilayer structure having an innermost seal layer, an outermost print layer and one or more optional intermediate layers sandwiched between the innermost layer and the outermost layer. The intermediate layers may include barrier layers, adhesive layers, and combinations thereof. The multilayer film may be produced by way coextrusion, lamination, and combinations thereof.

In an embodiment, the innermost layer is an ethylene-based polymer such as LLDPE and the outermost layer is selected from a polyester, a BOPP, OPET, and HDPE. The polyester allows for printing to be easily placed directly on the body because it does not stretch during the printing process. The innermost LLDPE layer allows for the formation of a peripheral heat seal that is hermetic, air-tight, and water-tight.

In an embodiment, the body is made from two flexible films of the same structure and the same composition. Each flexible film is a multilayer structure having an LLDPE sealant layer, an LDPE, LLDPE or HDPE intermediate layer, and a PET print layer. The LLDPE for the sealant layer has a secant flexural modulus from 20,000 psi to 50,000 psi as measured in accordance with ASTM D882. Each film has a thickness from 90 microns to 110 microns. Each film has a secant flexural modulus from 20,000 psi to 250,000 psi. The sealed flexible films produce a body (at seal area) that has a thickness from 180 microns to 220 microns.

The hand-feel perception of the body is related to the surface roughness of the flexible film at the microscopic level. Surface roughness, also known as surface profile, $R_a$, is a measurement of surface finish. It is topography at a scale that might be considered "texture" on the surface. Surface roughness is a quantitative calculation of the relative roughness of a linear profile or area, expressed as a single numeric parameter ($R_a$). The surface roughness of the container body can be measured with a confocal laser microscope, for example. A nonlimiting example of a suitable instrument for measuring surface roughness is a ZeMapper Optical Profiler, manufactured by Zemetrics, Inc., Tuscon, Ariz., USA.

In an embodiment, the body has a surface roughness, Ra, from 0.2 to 0.8.

In an embodiment, the body includes an upper heat seal portion. The upper heat seal portion includes a hole. The hole is a cut-out area and may be formed by way of a die-cut process, for example. The hole enables hanging or suspension of the container from a support structure. Nonlimiting examples of support structures suitable for hanging the container include hook, hanger, door handle, faucet, bathroom fixture, plumbing fixture, door handle, and shower caddy.

2. Base

The present container includes a base attached to the open bottom of the body. The base includes a floor and a peripheral rim extending below the floor. The base is inserted into the open bottom of the body, and attached thereto to form a hermetic seal. Nonlimiting procedures for sealing the base to the body include heat seal, ultrasonic seal, Radio-frequency (RF) sealing, weld, adhesive seal, and combinations thereof. Attachment of the base to the body forms a closed and watertight chamber.

The watertight chamber holds a liquid. Nonlimiting examples of suitable liquids include liquid personal care products such as shampoo, conditioner, liquid soap, lotion, gel, cream, balm, and sunscreen. Other suitable liquids include household care/cleaning products and automotive care products. Other suitable liquids include liquid food such as condiments (ketchup, mustard, mayonnaise) and baby food.

The base is made of a rigid polymeric material. A polymeric material is formed into a rigid part resulting in the base. Nonlimiting examples of suitable polymeric materials include propylene-based polymer and high density polyethylene. When formed into the rigid part, the—polymeric material provides the base with (1) the structural integrity to support the body and the liquid in the chamber without leakage, and (2) the stability to stand on the peripheral rim without tipping over. In this sense, the container is a "stand-up" container. In an embodiment, HDPE is injection molded and shaped into a rigid part to form the base.

In an embodiment, the cross-section of the body (at the greatest length) is greater than the cross-section of the base (taken at the greatest length).

The peripheral rim defines a footprint for the container. The "footprint" is the bottommost surface of the peripheral rim that contacts a support surface when the container is placed upright on the support surface. The peripheral rim also defines a footprint area. The "footprint area," as used herein, is the planar area under the base surrounded by the peripheral rim footprint. The peripheral rim contacts and supports the container along the footprint when the container is placed on a support surface. In the upright position of the container (base on bottom and supporting the body from below), the peripheral rim supports the container and the floor is located at a position above the support surface and not contacting the support surface. In this way, the peripheral rim forms the footprint for the container.

The footprint can have a variety of shapes. Nonlimiting examples of suitable shapes for the footprint include circle, square, rectangle, triangle, ellipsoid, eye-shape, and teardrop.

In an embodiment, the footprint has an eye-shape.

3. Nozzle

The present container includes a nozzle. The nozzle is annular in shape and extends from the floor. The nozzle is the dispensing opening for the container.

The nozzle may be integral to the base. Alternatively, the nozzle can be a separate component that is attached to the base by way of heat seal or ultrasonic seal or welding, for example. In an embodiment, the nozzle is integral to the base, the base (with nozzle) being formed from an ethylene-based polymer as a single integral component in an injection molding process. In a further embodiment, the nozzle is composed of HDPE.

The nozzle is centrally located on the floor and is surrounded by the peripheral rim. The length of the nozzle is less than or equal to the length the peripheral rim. In this way, the nozzle tip may contribute to the container footprint.

4. Closure

The present container includes a closure. The closure includes a panel-cap having an aperture through which the liquid in the chamber is dispensed. The closure includes an annular member that supports the panel-cap. The annular member operatively communicates with the nozzle by slidingly engaging the outer surface of the nozzle. The nozzle and the closure together form a push-pull closure assembly.

The term "panel-cap," as used herein, is a flat and extended structure, the panel-cap having an area at least 15% of the footprint area. In an embodiment, the panel-cap covers an area (or has an area) from 15%, or 18%, or 20%, or 25%, or 30%, or 35%, or 40% or 45% to 50%, or 55%, or 60% of the footprint area.

In an embodiment, the footprint area is from 2900 $mm^2$, or 3000 $mm^2$, or 3100 $mm^2$ to 3200 $mm^2$, or 3300 $mm^2$.

In an embodiment, the panel-cap has a surface area from 400 $mm^2$, or 450 $mm^2$, or 500 $mm^2$ to 550 $mm^2$, or 600 $mm^2$, or 650 $mm^2$.

In an embodiment, the footprint area is from 3000 $mm^2$ to 3200 $mm^2$ and the panel-cap area is from 500 $mm^2$ to 600 $mm^2$.

In an embodiment, the panel-cap has a thickness from 1.0 mm, or 2.0 mm to 3.0 mm, or 4.0 mm, or 5.0 mm, or 6.0 mm.

The panel-cap is made from a rigid polymeric material. Nonlimiting examples of suitable polymeric materials include propylene-based polymer and high density polyethylene. In an embodiment, the closure (including the panel-cap) is made of the same material as the base and nozzle. In a further embodiment, the base, nozzle, and panel-cap each is made from the same rigid HDPE.

The closure has a closed position and an open position. In the closed position, the tip of the nozzle matingly engages with the aperture of the panel-cap and blocks fluid flow through the aperture. In the closed position, the panel-cap contributes to the container footprint when the container is placed on a support surface. The bottom surface of the panel-cap is coplanar with the bottom surface of the peripheral rim when the closure is in the closed position. The large surface area of the panel-cap (i.e., at least 15% of the footprint area) advantageously contributes to the stability of the container when placed on a support surface.

When the closure is in the open position, a gap is present between the tip of the nozzle and the aperture permitting fluid flow through the aperture.

To move the closure from the closed position to the open position, a user moves one or more fingers into the recess formed by the peripheral rim and the floor of the base. The user then places the finger(s) on the top surface of the panel-cap and pulls the panel-cap away from the body. The pulling motion removes the nozzle tip from the aperture, creating a gap between the nozzle tip and the aperture, and thereby opening the aperture and permitting fluid flow from the chamber, through the nozzle, and through the aperture. In an embodiment, the panel-cap defines a fingerhold for the user.

When the closure is in the open position, the panel-cap extends beyond the peripheral rim. To close the opened closure, the user holds the container and pushes the panel-cap against an object. The large surface area of the panel-cap advantageously enables quick and easy closing of the closure. The object can be a flat surface (vertical or horizontal) such as a shower wall, a sink basin, a countertop, or the like. The object can be smaller than the panel-cap; such as an edge of a surface, or a plumbing fixture (such as a faucet handle). In this way, the large surface area of the panel-cap advantageously enables easy single-hand closing of the container.

Alternatively, if the container with closure in the open position is hanging from a support structure (by way of the hole in the upper heat seal portion of the body), the user can simply place her hand below the container, bring her hand in an upward motion to contact the panel-cap and close the closure. Again, the panel-cap advantageously enables single-hand closing of the closure. This is advantageous in the shower, for example, when user may have only one hand available (one hand holding liquid product from the container or holding another object such as a bar of soap, for example) and/or eyes closed.

When the closure is in the open position and the base of the container is placed on a horizontal support surface, or placed on a substantially horizontal support surface, the weight of the container moves the container downward to close the closure (or otherwise move the closure from the open position to the closed position). The mass of the container is sufficient for gravity to pull the container downward and close the open closure. In this way, the present container is advantageously "self-closing" such that the weight of the container itself is sufficient to close the open closure when the container is placed on a horizontal (or substantially horizontal) support surface. Further advantages of the present self-closing container include hands-free closing, reduction in leak, reduction in drip, and reduction in spill of liquid contents.

The present container advantageously provides inverted dispensing without the use of a flip cap. In other words, the present container is hinge-free.

In an embodiment, the closure of the present container does not include a silicone valve (no silicone slit valve, for example). Consequently, the present container in silicone-free.

The panel-cap can have a variety of shapes. Nonlimiting examples of suitable shapes for the panel-cap include circle, square, rectangle, triangle, ellipsoid, teardrop, and eye-shape.

In an embodiment, the shape of the panel-cap is the same as the shape of the footprint formed by the peripheral rim. In other words, the shape of the peripheral rim perimeter matches the shape of the perimeter of the panel-cap, or otherwise matches the shape of the peripheral rim.

In an embodiment, the container is made from 90 wt % to 100 wt % ethylene-based polymer—the body being composed of flexible multiple layer film with layer materials selected from ethylene-based polymer such as LLDPE, LDPE, HDPE, and combinations thereof, and the base, nozzle and closure are composed of rigid HDPE. The container made from 90 wt % to 100 wt ethylene-based polymer is advantageous as it is readily recyclable.

In an embodiment, the height of the container (in millimeters) is from 2 times (2×) to 4 times (4×) greater than the length of the base. In a further embodiment, the height of the container is three times (3×) the length of the base.

In an embodiment, the container has a height from 200 mm, or 250 mm to 275 mm, or 280 mm, or 290 mm, or 300 mm.

In an embodiment, the base has a length from 70 mm, or 75 mm, or 80 mm to 85 mm, or 90 mm, or 95 mm, or 100 mm.

In an embodiment, the container has a height of 255 mm, the base has a length of 84 mm, and the container holds 355 milliliters (ml) (12 ounces) liquid.

In an embodiment, the container has a height of 280 mm, the base has a length of 84 mm, and the container holds 592 ml (20 ounces) liquid.

In an embodiment, the height of the container is from 5 times (5×), or 10 times (10×), or 15 times (15×) to 20 times (20×), or 25 times (25×), or 30 times (30×), or 35 times (35×)

greater than the height of the base (in millimeters). In other words, the container has a body-to-base ratio from 5-35:1.

In an embodiment, the present container has a body-to-base ratio from 15:1 to 30:1. This large body-to-base ratio demonstrates an advantage of the present container. The size of the base is minimized so as to maximize the container body volume and concomitantly maximize the amount of liquid contained in the body. In this way, the present container reduces the container material (thereby reducing production costs) to maximize liquid product content. Applicant discovered that the panel-cap with an area 15-50% the surface area of the footprint area provides unexpected stability and support to effectuate the large body-to-base ratio of 15-30:1 for the present container.

The small presence of the base in the 15-30:1 body-to-base ratio optimizes container design and configuration by (1) enabling complete, or substantially complete, dispensing of all liquid in the chamber; and (2) reducing the weight of the container.

The container may be formed and filled by way of a vertical form, fill, and seal procedure. The body is formed first by heat sealing two flexible films along a common periphery. Liquid is subsequently introduced into the chamber through the open bottom of the body. The base is then sealed to the open bottom of the body, closing the chamber.

Alternatively, the container is formed by sealing the base to the open bottom of the flexible body. The liquid is introduced through the open aperture through the nozzle, to fill the chamber.

DEFINITIONS

The numerical figures and ranges here are approximate, and thus may include values outside of the range unless otherwise indicated. Numerical ranges (e.g., as "X to Y", or "X or more" or "Y or less") include all values from and including the lower and the upper values, in increments of one unit, provided that there is a separation of at least two units between any lower value and any higher value. As an example, if a compositional, physical or other property, such as, for example, temperature, is from 100 to 1,000, then all individual values, such as 100, 101, 102, etc., and sub ranges, such as 100 to 144, 155 to 170, 197 to 200, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. For ranges containing explicit values (e.g., 1 or 2, or 3 to 5, or 6, or 7) any subrange between any two explicit values is included (e.g., 1 to 2; 2 to 6; 5 to 7; 3 to 7; 5 to 6; etc.).

An "ethylene-based polymer," as used herein is a polymer that contains more than 50 mole percent polymerized ethylene monomer (based on the total amount of polymerizable monomers) and, optionally, may contain at least one comonomer.

An "olefin-based polymer," as used herein is a polymer that contains more than 50 mole percent polymerized olefin monomer (based on total amount of polymerizable monomers), and optionally, may contain at least one comonomer. Nonlimiting examples of olefin-based polymer include ethylene-based polymer and propylene-based polymer.

"Polymer" means a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term interpolymer, usually employed to refer to polymers prepared from at least two types of monomers. It also embraces all forms of interpolymers, e.g., random, block, etc. The terms "ethylene/α-olefin polymer" and "propylene/α-olefin polymer" are indicative of interpolymers as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is obviously understood to be referring to the polymerized remnant of the specified monomer and not to the unpolymerized species. In general, polymers herein are referred to has being based on "units" that are the polymerized form of a corresponding monomer.

A "propylene-based polymer" is a polymer that contains more than 50 mole percent polymerized propylene monomer (based on the total amount of polymerizable monomers) and, optionally, may contain at least one comonomer.

The term "tottle," as used herein, is a package comprising a bottle and a closure attached to the bottle, wherein the package is designed to rest on its closure. Many shampoos, hair conditioners, shaving lotions, body washes, in-shower body moisturizers, and other products used in the shower or bath are contained in tottles. Many food condiments are also contained in tottles, such as ketchup, mayonnaise, mustard, and the like. In one embodiment, the present container is a tottle.

EXAMPLES

The following is one embodiment of the present disclosure, as depicted in the drawings. While this describes one embodiment of the present disclosure, it will be apparent to those skilled in the art that various changes and modifications can be made without departing from the spirit and scope of the disclosure.

Figure 2:
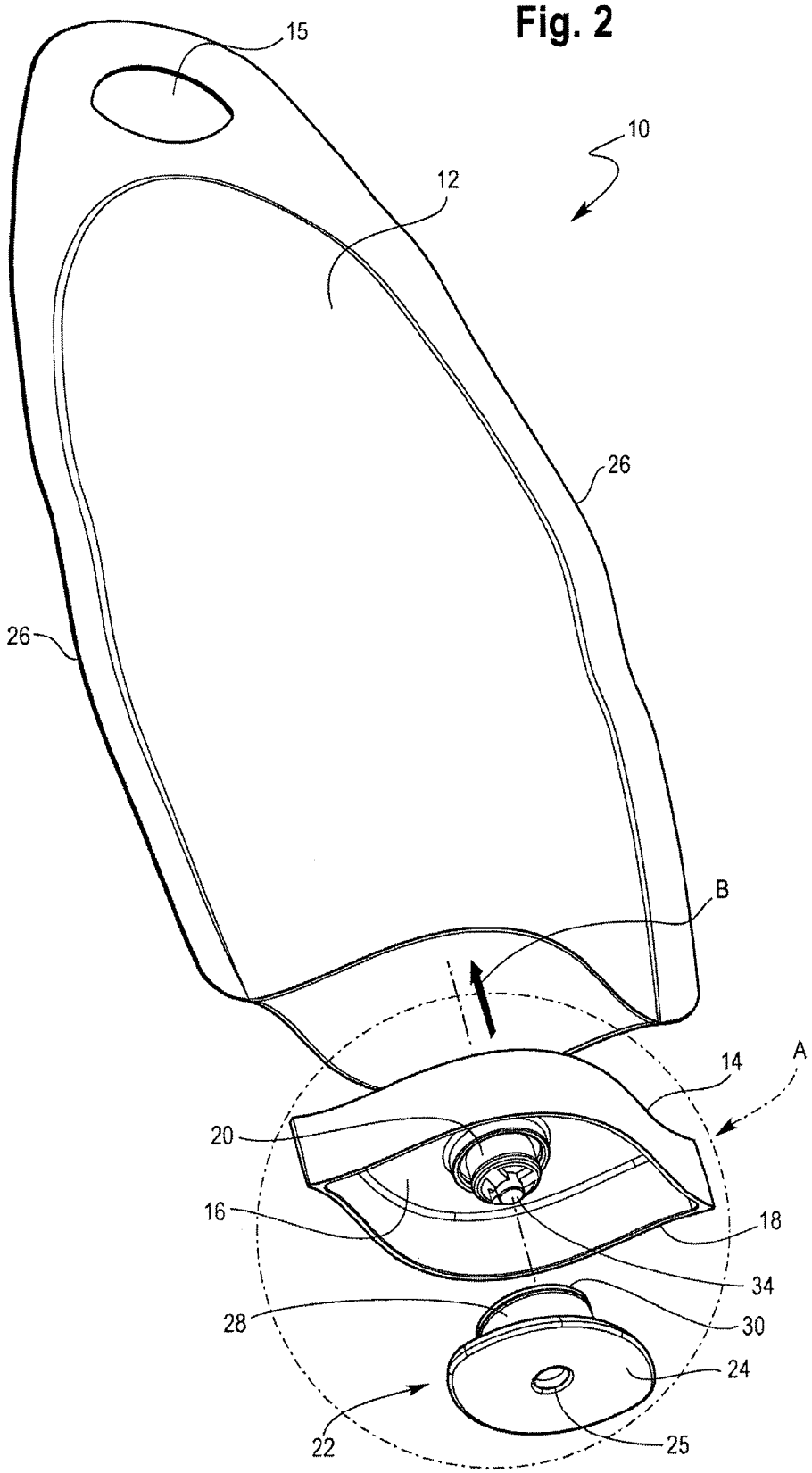
FIG. 2 is an exploded view of a container in accordance with an embodiment of the present disclosure.
Figure 3:
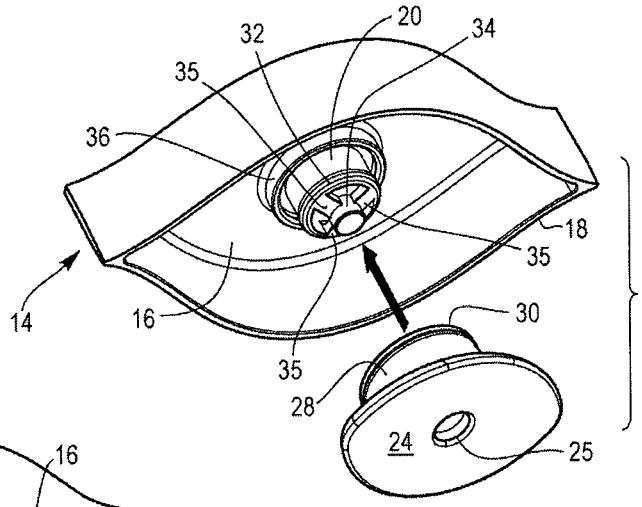
FIG. 3 is an enlarged perspective view of area A of FIG. 2.
Figure 4:
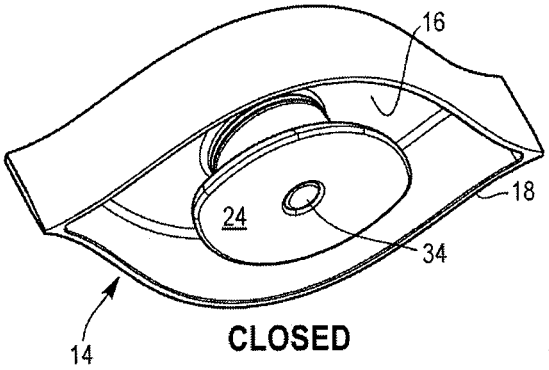
FIG. 4 is a perspective view of the closure of the container of FIG. 1 in a closed position in accordance with an embodiment of the present disclosure.

FIG. 1 shows a bottom perspective view of a container 10 for dispensing a liquid. FIG. 2 is an exploded bottom perspective view of the container 10. The container 10 includes a flexible body 12 and a base 14. The base 14 includes a floor 16 and a peripheral rim 18 that extends below the floor. A nozzle 20 is centrally located on the floor 16. A closure 22 is slidingly engaged with the nozzle 20. The location of the nozzle on the floor keeps the liquid in a position to readily flow from body 12. The closure includes a panel-cap 24 and an aperture 25 through which the liquid is dispensed.

A heat seal 26 extends along a common periphery of two flexible films. The heat sealed films forms the body 12 with a closed top and an open bottom. Each flexible film is a multilayer laminate composed of a PET print layer/tie/LDPE core layer/LLDPE seal layer. In an embodiment, the sealed film structure has a thickness of 200 microns.

A hole 15 is located at an upper heat seal portion of the body 12. The hole 15 is a cut out for hanging the container 10 from a support structure, such as a hanger, for example.

The base 14 is made of rigid HDPE. As shown by arrow B in FIG. 2, the base 14 is inserted into the open bottom of the body 12. The base 14 is then attached to the open end of the body 12 by sealing (heat seal, adhesive seal, or weld (ultrasonic or RF)) to form a hermetically-sealed chamber for holding a liquid.

Figure 5:
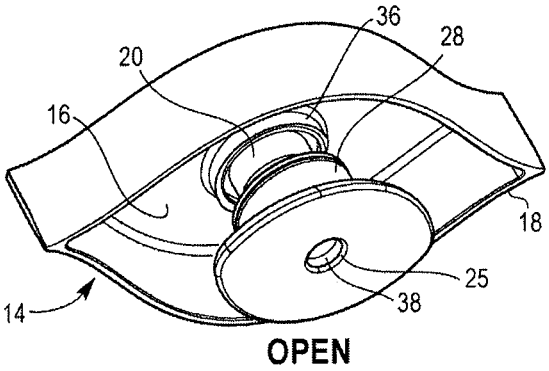
FIG. 5 is a perspective view of the closure of the container of FIG. 1 in an open position in accordance with an embodiment of the present disclosure.

As shown in FIGS. 1-6, the nozzle 20 is centrally located on the floor 16. The nozzle 20 extends downward and away from the floor 16. The closure is a push-pull closure. The closure includes the panel-cap 24 and an annular member 28. The annular member 28 slidingly engages along the outer surface of the nozzle 20 in a push-pull, or a back-and-forth, manner. The closure 22 slides along the nozzle 20 and moves between a closed position (FIG. 4) and an open position (FIG. 5). A lip 30 on the annular member 28 abuts a block rim 32 on the nozzle 20 (i) stopping extension of the closure 22 along the nozzle 20, (ii) defining the maximum extension of the closure 22 along the nozzle 20, and (iii) keeping the closure 22 attached to the nozzle 20 when in the open position.

When the closure 22 is in the closed position (FIG. 4), a nozzle tip 34 matingly engages with the aperture 25 and blocks, or otherwise prevents, liquid from flowing through the aperture 25. Bars 35 extend from the outer periphery of the nozzle 20 radially inward to support and maintain the nozzle tip 34 in the center of nozzle 20. A sleeve 36 extends from the floor 16 and receives the end of the annular member 28. In the closed position, the liquid is not dispensed from the closure 22.

To place the closure 22 in the open position, a user places one or more fingers on the top surface of the panel-cap 24. The user then pulls the panel-cap 24 away from the floor 16. The annular member 28 moves away from the sleeve 36 to produce a gap 38 between the nozzle tip 34 and the aperture 25 as shown in FIG. 5. The user squeezes the body 12 and liquid from the chamber flows through the nozzle 20, through the gap 38 and is dispensed from the closure 22 through the aperture 25.

Figure 6:
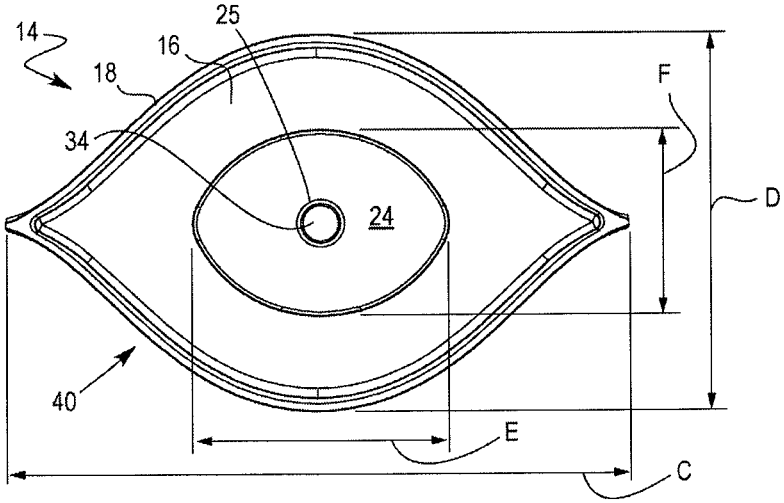
FIG. 6 is a bottom plan view of the base and closure in accordance with an embodiment of the present disclosure.

In FIG. 6, the peripheral rim 18 defines a footprint area 40. The footprint area 40 has a teardrop shape. The panel-cap 24 has a teardrop shape that matches the teardrop shape of the footprint area 40. The panel-cap has an area that is from 15% to 50% the area of the footprint area.

In an embodiment, the footprint area 40 is 3157 $mm^2$ and the panel-cap area is 572 $mm^2$.

In an embodiment, the panel-cap area is 18% of the footprint area.

In FIG. 6, the shape of the footprint area 40 formed by the peripheral rim 18 is an eye-shape. The shape defined by the panel-cap 24 is an eye-shape. In this way, the shape of the footprint area 40 and the shape of the panel-cap 24 are the same.

Figure 7:
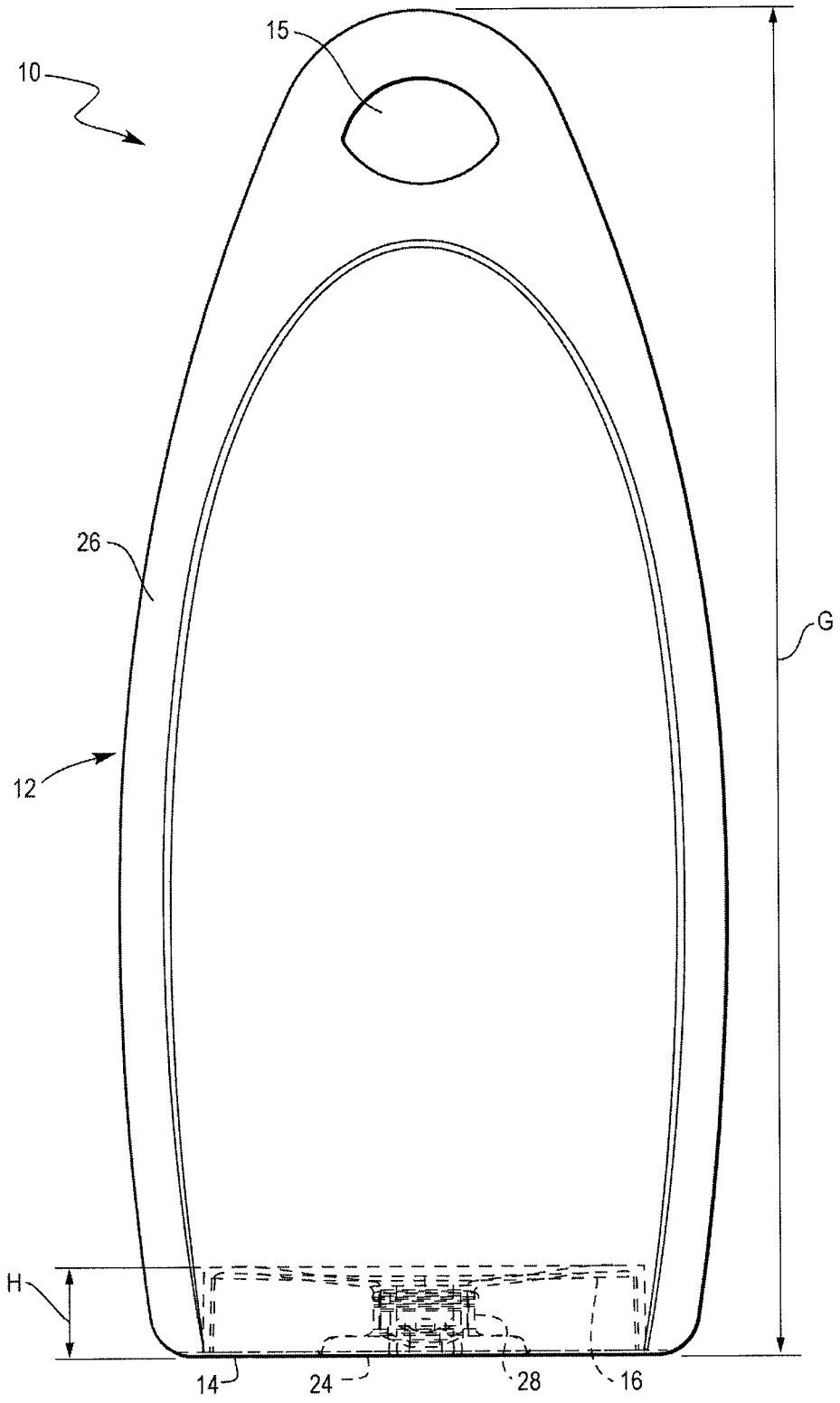
FIG. 7 is a front elevational view of the container with the base and closure shown in dotted lines, in accordance with an embodiment of the present disclosure.

As shown in FIGS. 6-7, the base 14 has a length indicated by distance C and a width indicated by distance D. The panel-cap 24 has a length indicated by distance E and a width indicated by distance F. The container 10 has a height indicated by distance G. The base 14 has a height indicated by distance H.

In millimeters, the length of C is from two times (2×) to 3 times (3×) greater than the length of distance E. In an embodiment, C is 84 mm and E is 31 mm.

In millimeters, the length G is from 2 times (2×) to 4 times (4×) greater than the length of distance C (length of base 14). In an embodiment, distance G is three times (3×) greater than the length of distance C.

In millimeters, the length of G is from 15 times (15×) to 30 times (30×) greater than the length of H. In this way, the present container 10 has a large body-to-base ratio, the body-to-base ratio being from 15:1 to 30:1.

It is specifically intended that the present disclosure not be limited to the embodiments and illustrations contained herein, but include modified forms of those embodiments including portions of the embodiments and combinations of elements of different embodiments as come within the scope of the following claims.

The invention claimed is:

1. A container comprising:

a flexible body having a closed top and an open bottom, the body defining a chamber for holding a liquid, the flexible body constructed from two multilayer flexible films, each multilayer film having an innermost seal layer and an outermost print layer;

a base attached to the open bottom of the body, the base comprising a floor and a peripheral rim extending below the floor, a nozzle centrally located on the floor and extending from the floor, the nozzle surrounded by the peripheral rim;

the multilayer films sealed along a peripheral seal extending from a first side of the base, along an upper portion of the body, and to a second side of the base;

a closure slidingly engaged with the nozzle, the closure comprising a panel-cap having an aperture through which the liquid is dispensed, the panel-cap having a bottom surface with a length and a width, and the panel-cap length is greater than the panel-cap width; and the container is a hinge-free tottle container comprising from 90 wt % to 100 wt % ethylene-based polymer.

2. The container of claim 1 wherein the panel-cap has an area that is at least 15% of a footprint area defined by the peripheral rim.

3. The container of claim 1 wherein the closure has a closed position wherein a tip of the nozzle matingly engages with the aperture and blocks fluid flow through the aperture.

4. The container of claim 1 wherein the closure has an open position wherein a gap is present between a tip of the nozzle and the aperture, permitting fluid flow through the aperture.

5. The container of claim 1 wherein the body comprises an upper heat seal portion, the upper heat seal portion comprising a hole for hanging the container from a support structure.

6. The container of claim 1 wherein the peripheral rim defines a footprint having an eye-shape; and the panel-cap has an eye-shape that matches the eye-shape of the peripheral rim footprint.

7. The container of claim 1 wherein a top surface of the panel-cap defines a fingerhold for a user.

8. The container of claim 1 wherein a height of the container is from 15 times to 30 times greater than a height of the base.

9. The container of claim 1 wherein the bottom surface of the panel-cap is coplanar with a bottom surface of the rim when the closure is in the closed position.

10. The container of claim 1 wherein the closure has an open position wherein the panel-cap extends beyond the peripheral rim and placing the base on a support surface moves the closure to a closed position.

11. The container of claim 1 wherein the body has a surface roughness, Ra, from 0.2 to 0.8.

12. The container of claim 1 wherein the panel-cap has a thickness from 1.0 mm to 3.0 mm.

13. The container of claim 1 wherein each multilayer film comprises an innermost layer comprising linear low density polyethylene and an outermost print layer comprising a polyester.

14. The container of claim 1 wherein each multilayer film has a thickness from 25 microns to 125 microns.

15. The container of claim 1 wherein the cross-section of the body is greater than the cross-section of the base.

* * * * *